US006137226A

United States Patent [19]

Nagano

[11] Patent Number: 6,137,226

[45] Date of Patent: Oct. 24, 2000

[54] PLASMA DISPLAY PANEL

[75] Inventor: Shinichiro Nagano, Tokyo, Japan

[73] Assignee: Mitsubishi Denki Kabushiki Kaisha, Tokyo, Japan

[21] Appl. No.: 09/041,730

[22] Filed: Mar. 13, 1998

[30] Foreign Application Priority Data

Mar. 14, 1997 [JP] Japan ..... 9-060930

[51] Int. Cl.[7] ..... H01J 17/49

[52] U.S. Cl. ..... 313/582; 313/586; 313/587

[58] Field of Search ..... 313/485, 486, 313/487, 488, 489, 582, 583, 584, 585, 586, 587

[56] References Cited

U.S. PATENT DOCUMENTS

| | | | |
|---|---|---|---|
| 5,182,489 | 1/1993 | Sano | 313/485 |
| 5,541,479 | 7/1996 | Nagakubo | 313/586 |
| 5,661,500 | 8/1997 | Shinoda et al. | 313/585 |
| 5,742,122 | 4/1998 | Amemiya et al. | 313/582 |
| 5,818,168 | 10/1998 | Ushifusa et al. | 313/582 |
| 5,872,425 | 2/1999 | Shino et al. | 313/582 |
| 5,952,782 | 9/1999 | Nanto et al. | 313/584 |

FOREIGN PATENT DOCUMENTS

| | | |
|---|---|---|
| 0762373A2 | 3/1997 | European Pat. Off. . |
| EP0762463 A2 | 3/1997 | European Pat. Off. . |
| 2-226639 | 9/1990 | Japan . |
| 5190099 | 7/1993 | Japan . |
| 6-267434 | 9/1994 | Japan . |
| 8250029 | 9/1996 | Japan . |
| 9-102280 | 4/1997 | Japan . |
| 935642 | 7/1997 | Japan . |

OTHER PUBLICATIONS

Patent Abstracts of Japan, vol. 014, No. 520 (E–1002) Nov. 14, 1990 (JP 02 220330 A) Abstract Only.

Patent Abstracts of Japan, vol. 097, No. 008, Aug. 29, 1997 (JP 09 102280 A) Abstract Only.

Patent Abstracts of Japan, vol. 096, No. 002, Feb. 29, 1996 (JP 07 262930 A) Abstract Only.

Patent Abstracts of Japan, vol. 009, No. 173 (E–329) Jul. 18, 1985 (JP 60 047341 A) Abstract Only.

*Primary Examiner*—Ashok Patel

[57] ABSTRACT

When two facing electrodes forming a first set are spaced at a large interval, a first electrode in the first set is prone to erroneously discharge with a second electrode forming a second set separated from the first set. A plasma display panel comprises: a first glass substrate and a second glass substrate facing each other; a plurality of sets of discharge sustain electrodes, each set including one common electrode and two independent electrodes on both sides of the common electrode provided on a surface of the first glass substrate that faces the second glass substrate, the common electrode and the two independent electrodes extending in parallel with each other; a dielectric layer coating the plurality of sets of discharge sustain electrodes; a plurality of address electrodes provided in parallel in a direction perpendicular to the common electrodes on a surface of the second glass substrate that faces the first glass substrate with a space interposed between the dielectric layer and the address electrodes; partitions provided between adjacent ones of the address electrodes between the first and second glass substrates; a phosphor coating the partitions; and first insulating parts provided in positions facing the common electrodes with the dielectric layer interposed therebetween.

19 Claims, 7 Drawing Sheets

PLASMA DISPLAY PANEL

BACKGROUND OF THE INVENTION

1. Field of the Invention

The present invention relates to plasma display panels, and particularly to a surface-discharge type plasma display panel.

2. Description of the Background Art

FIG. 5 is a perspective view showing a first conventional structure of a surface-discharge type plasma display panel. In FIG. 5, the character 1 denotes a front glass substrate as a first glass substrate. The characters $\mathbf{2}x_n$ to $\mathbf{2}x_{n+2}$ denote x sustain discharge electrodes formed of transparent conductive film, which are provided on the front glass substrate 1. The characters $\mathbf{2}y_n$ to $\mathbf{2}y_{n+1}$ denote y sustain discharge electrodes formed of transparent conductive film, which are provided on the front glass substrate 1. In this background art, these x sustain discharge electrodes and the corresponding ones of the y sustain discharge electrodes, e.g., the x sustain discharge electrode $\mathbf{2}x_n$ and the y sustain discharge electrode $\mathbf{2}y_n$, are provided adjacently and in parallel with each other to form one set.

The characters $\mathbf{3}x_n$ to $\mathbf{3}x_{n+2}$ denote x bus electrodes that are laid on the x sustain discharge electrodes $\mathbf{2}x_n$ to $\mathbf{2}x_{n+2}$ to supply voltage to the x sustain discharge electrodes $\mathbf{2}x_n$ to $\mathbf{2}x_{n+2}$. For example, the x bus electrode $\mathbf{3}x_n$ supplies voltage to the x sustain discharge electrode $\mathbf{2}x_n$. The characters $\mathbf{3}y_n$ to $\mathbf{3}y_{n+1}$ denote y bus electrodes laid on the y sustain discharge electrodes $\mathbf{2}y_n$ to $\mathbf{2}y_{n+1}$ for supplying voltage to the y sustain discharge electrodes $\mathbf{2}y_n$ to $\mathbf{2}y_{n+1}$. For example, the y bus electrode $\mathbf{3}y_n$ supplies voltage to the y sustain discharge electrode $\mathbf{2}y_n$. The x bus electrodes and the y bus electrodes in this background art, e.g., the x bus electrode $\mathbf{3}x_n$ and the y bus electrode $\mathbf{3}y_n$, are provided adjacently and in parallel with each other to form one set.

The character 4 denotes a dielectric layer, which covers the x sustain discharge electrodes $\mathbf{2}x_n$ to $\mathbf{2}x_{n+2}$, the y sustain discharge electrodes $\mathbf{2}y_n$ to $\mathbf{2}y_{n+1}$, the x bus electrodes $\mathbf{3}x_n$ to $\mathbf{3}x_{n+2}$, and the y bus electrodes $\mathbf{3}y_n$ to $\mathbf{3}y_{n+1}$. The character 5 denotes a cathode film formed of magnesium oxide (hereinafter referred to as MgO), which is deposited on the dielectric layer 4 and functions as a protector and a cathode when discharging. The character 6 denotes a rear glass substrate as a second glass substrate, which forms a pair with the front glass substrate 1 with the dielectric layer 4 and the like therebetween.

The character 7 denotes address electrodes, which are arranged on the rear glass substrate 6 in a direction normal to the direction in which the x sustain discharge electrodes $\mathbf{2}x_n$ to $\mathbf{2}x_{n+2}$ and the y sustain discharge electrodes $\mathbf{2}y_n$ to $\mathbf{2}y_{n+1}$ extend. A discharge space is provided between the cathode film 5 and the address electrodes 7. This discharge space is filled with mixture gas containing neon (Ne) and xenon (Xe). The character 8 denotes barrier ribs (hereinafter referred to as partitions), which are provided between adjacent address electrodes 7. The projecting ends of the partitions 8 are in contact with the cathode film 5 to divide the discharge space into a plurality of cells.

The characters 9R, 9G and 9B denote red, green, and blue phosphors, respectively, which are applied on the surface of the address electrodes 7 and the side wall of partitions 8. The character 10 denotes discharge deactivation films, which are placed to face the spaces between the y sustain discharge electrodes and x sustain discharge electrodes in adjacent sets, e.g., the space between the y sustain discharge electrode $\mathbf{2}y_n$ and the x sustain discharge electrode $\mathbf{2}x_{n+1}$, with the dielectric layer 4 and the cathode film 5 interposed therebetween. This discharge deactivation films 10 are formed of an insulating material. The width of the discharge deactivation films 10 does not exceed the sum of the widths of a y sustain discharge electrode and an x sustain discharge electrode in adjacent sets and the width of the interval between the y sustain discharge electrode and the x sustain discharge electrode in the adjacent sets.

Next, the driving sequence, or the operation of the surface-discharge type plasma display panel described referring to FIG. 5 will be described.

Step A1: Line-Sequential Write Discharge

The y sustain discharge electrodes $\mathbf{2}y_n$ to $\mathbf{2}y_{n+1}$ are line-sequentially scanned. Picture signal corresponding to the image data to be outputted to the plasma display panel is outputted to the address electrodes 7 in synchronization with the line-sequential scanning. This causes write discharge, or the AC discharge at the intersections of the y sustain discharge electrodes $\mathbf{2}y_n$ to $\mathbf{2}y_{n+1}$ and the address electrodes 7 between $\mathbf{2}y_n$ and $\mathbf{2}x_n$, or between $\mathbf{2}y_{n+1}$ and $\mathbf{2}x_{n+1}$. Then wall charge is accumulated on the surface of the cathode film 5 in the vicinities of the y sustain discharge electrodes $\mathbf{2}y_n$ to $\mathbf{2}y_{n+1}$ that have made the write discharge. On the other hand, wall charge of the opposite polarity is accumulated on the surface of the cathode film 5 in the vicinities of the x sustain discharge electrodes $\mathbf{2}x_n$ to $\mathbf{2}x_{n+1}$.

Step A2: Sustain Discharge between x and y

The line-sequential write discharge is followed by sustain discharge, or the AC discharge for sustaining the discharge state between the y sustain discharge electrodes $\mathbf{2}y_n$ to $\mathbf{2}y_{n+1}$ that have made the write discharge and the corresponding ones of the x sustain discharge electrodes $\mathbf{2}x_n$ to $\mathbf{2}x_{n+2}$, e.g., between the y sustain discharge electrode $\mathbf{2}y_n$ and the x sustain discharge electrode $\mathbf{2}x_n$.

Step A3: Entire-Surface Write Discharge

Independently of the presence/absence of wall charge accumulated on the surface of the cathode film 5, a voltage required to make write discharge is applied between the opposing x sustain discharge electrodes $\mathbf{2}x_n$ to $\mathbf{2}x_{n+2}$ and y sustain discharge electrodes $\mathbf{2}y_n$ to $\mathbf{2}y_{n+1}$ laid on the entire surface of the front glass substrate 1.

Step A4: Entire-Surface Erase Discharge

Erase pulse is applied between the opposing x sustain discharge electrodes $\mathbf{2}x_n$ to $\mathbf{2}x_{n+2}$ and y sustain discharge electrodes $\mathbf{2}y_n$ to $\mathbf{2}y_{n+1}$ laid on the entire surface of the front glass substrate 1 to erase wall charge unwanted in the next driving sequence A1.

The phosphor 9R receives ultra-violet rays emitted in the process of discharge to emit fluorescent red color. Similarly, the phosphor 9G emits green color and the phosphor 9B emits blue color.

FIG. 6 is a sectional view of the conventional surface-discharge type plasma display panel shown in FIG. 5. This sectional view of the plasma display panel in FIG. 6 does not show the rear glass substrate 6, the address electrodes 7, the partitions 8 and the phosphors 9R, 9G and 9B. This technique is disclosed in Japanese Patent Laying-Open No.9-102280, for example.

FIG. 7 is a sectional view showing a second conventional structure of a surface-discharge type plasma display panel. In FIG. 7, the same reference characters as those in the conventional example shown in FIG. 5 and FIG. 6 show the same or corresponding parts, which are not described here again. In this conventional example, one x sustain discharge electrode, e.g., the x sustain discharge electrode $2x_m$, is provided between two y sustain discharge electrodes, e.g., between the y sustain discharge electrode $2y_n$ and the y sustain discharge electrode $2y_{n+1}$.

In this conventional example, one x bus electrode and two y bus electrodes form one set. This technique is disclosed in Japanese Patent Laying-Open No.2-226639, for example. The plasma display panel of the second structure has nothing corresponding to the discharge deactivation films 10 provided in the plasma display panel of the first structure.

For the aim of improving the light emission luminance of the surface-discharge type plasma display panel of the first structure to obtain a comfortable-to-see plasma display panel, it is necessary to arrange the opposing x bus electrodes $3x_n$ to $3x_{n+2}$ and y bus electrodes $3y_n$ to $3y_{n+1}$ in the respective sets, e.g., the y bus electrode $3y_n$ and the x bus electrode $3x_n$, at large intervals or gaps.

However, forming large gaps on the front glass substrate 1 between the opposing x bus electrodes $3x_n$ to $3x_{n+2}$ and y bus electrodes $3y_n$ to $3y_{n+1}$ in their respective sets, e.g., the gap between the y bus electrode $3y_n$ and the x bus electrode $3x_n$, is restricted because of the limited space of the front glass substrate 1. Furthermore, this raises the problem that the gaps between adjacent ones of the x bus electrodes $3x_n$ to $3x_{n+2}$ and the y bus electrodes $3y_n$ to $3y_{n+1}$, e.g., the gap between the y bus electrode $3y_{n-1}$ and the x bus electrode $3x_n$, become smaller, which will be liable to cause erroneous discharge between adjacent bus electrodes in different sets, e.g., between the y bus electrode $3y_{n-1}$ and the x bus electrode $3x_n$.

The erroneous discharge between adjacent bus electrodes in different sets, e.g., between the y bus electrode $3y_{n-1}$ and the x bus electrode $3x_n$ can be prevented by forming the discharge deactivation films 10 in positions facing the spaces between, e.g., the y bus electrode $3y_{n-1}$ and the x bus electrode $3x_n$ through the dielectric layer 4 and the cathode film 5.

It can be understood that the plasma display panel of the second structure corresponds to an improvement of the plasma display panel of the first structure made to decrease the total number of the x bus electrodes and y bus electrodes provided on the front glass substrate having a given number of cells by allowing two y bus electrodes to share one x bus electrode so that the facing x and y bus electrodes can be spaced at increased gaps to improve the light emission luminance for comfortable-to-see display.

However, in the plasma display panel of the second structure, when discharge starts between the y sustain discharge electrode $2y_n$ and the x sustain discharge electrode $2x_m$, for example, the wall charge accumulated before that on the cathode film 5 in the region above the x sustain discharge electrode $2x_m$ is uniformly reduced. Then the rise of discharge occurring thereafter between the y sustain discharge electrode $2y_{n+1}$ sharing the x sustain discharge electrode $2x_m$ with the y sustain discharge electrode $2y_n$ and the x sustain discharge electrode $2x_m$ will be especially unstable.

Furthermore, with the plasma display panel of the second structure, when the intervals between two adjacent y sustain discharge electrodes in adjacent sets, e.g., the interval between the y sustain discharge electrode $2y_{n-1}$ and the y sustain discharge electrode $2y_n$, are small, the x sustain discharge electrode $2x_m$ and the y sustain discharge electrode $2y_{n-1}$, for example, are prone to erroneously make discharge, involved in the discharge between the x sustain discharge electrode $2x_m$ and the y sustain discharge electrode $2y_n$.

SUMMARY OF THE INVENTION

A plasma display panel according to the present invention comprises: a first glass substrate and a second glass substrate facing each other; a plurality of sets of discharge sustain electrodes, each set including one common electrode and two independent electrodes on both sides of the common electrode, provided on a surface of the first glass substrate that faces the second glass substrate, the common electrode and the two independent electrodes extending in parallel with each other; a dielectric layer coating the plurality of sets of discharge sustain electrodes; a plurality of address electrodes provided in parallel in a direction perpendicular to the common electrodes on a surface of the second glass substrate that faces the first glass substrate with a space interposed between the dielectric layer and the address electrodes; partitions provided between adjacent ones of the address electrodes between the first and second glass substrates; a phosphor coating the partitions; and first insulating parts provided in positions facing the common electrodes with the dielectric layer interposed therebetween.

When a given number of cells are provided in a given space, a reduced number of discharge sustain electrodes are provided on the first glass substrate, which allows bus electrodes included in the opposing common electrodes and the bus electrodes included in independent electrodes to be spaced at increased intervals, thus improving the light emission luminance of the plasma display panel.

Furthermore, when one of the independent electrodes in a set of discharge sustain electrodes makes a discharge, the formation of the insulating part in a position facing the common electrode through the dielectric layer sustains the wall charge on the side of the other independent electrode provided on the other side of the common electrode in the same set, enabling the independent electrodes in the same set of discharge sustain electrodes to stably discharge.

Preferably, the plasma display panel according to the present invention further comprises second insulating parts provided in positions facing positions between adjacent ones of the independent electrodes in adjacent ones of the plurality of discharge sustain electrode sets with the dielectric layer interposed therebetween.

This prevents erroneous discharge between a common electrode in a certain discharge sustain electrode set and an independent electrode in an adjacent discharge sustain electrode set.

Preferably, in the plasma display panel according to the present invention, the first and second insulating parts are formed of such an insulating material that the requisite firing voltage between the independent electrodes and the common electrodes in the presence of the first or second insulating parts is higher than the firing voltage between the independent electrodes and the common electrodes in the presence of only a cathode film provided on the dielectric layer.

Then the flow of discharge current is controlled to prevent occurrence of erroneous discharge.

Preferably, in the plasma display panel according to the present invention, the first and second insulating parts are formed by depositing the insulating material on the dielectric layer or the cathode film while evaporating the insulating material.

This improves the visual contrast of the plasma display panel on the basis of the fact that the oxide exhibits blacker tone with lack of oxygen.

Preferably, in the plasma display panel according to the present invention, the insulating material is $Al_2O_3$ or $TiO_2$.

Since these substances require higher discharge voltage than the cathode film, the flow of discharge current is controlled.

Preferably, the plasma display panel according to the present invention further comprises independent parts formed of a material having a light-shielding property and provided on the first glass substrate between adjacent ones of the independent electrodes in adjacent ones of the plurality of discharge sustain electrode sets.

This prevents the white base of the phosphor from being seen through the gaps between adjacent independent electrodes in separated two discharge sustain electrode sets, thus improving the visual contrast of the plasma display panel.

Preferably, in the plasma display panel according to the present invention, the independent parts are formed of the same material as the independent electrodes.

Therefore the independent parts and the independent electrodes can be easily formed by using pattern design of photomask used in the same photolithography. The independent parts can thus be easily formed without adding any new process for formation of the independent parts.

Preferably, in the plasma display panel according to the present invention, the material of the independent parts is chromium.

Since chromium has dark metallic luster and a high light-shielding property, it improves the visual contrast of the plasma display panel.

The present invention has been made to solve the above-described problems, and an object of the present invention is to provide a plasma display panel that prevents the problem that when discharge starts between the y sustain discharge electrode $\mathbf{2}y_n$ and the x sustain discharge electrode $\mathbf{2}x_m$, for example, wall charge accumulated before that on the cathode film 5 in the region above the x sustain discharge electrode $\mathbf{2}x_m$ is uniformly reduced, so that the discharge made thereafter between the y sustain discharge electrode $\mathbf{2}y_{n+1}$ sharing the x sustain discharge electrode $\mathbf{2}x_m$ with the y sustain discharge electrode $\mathbf{2}y_n$ and the x sustain discharge electrode $\mathbf{2}x_m$ can rise in a stable manner.

Another object of the present invention is to provide a surface-discharge type plasma display panel that can prevent occurrence of erroneous discharge caused between an x bus electrode in a certain set and a y bus electrode in a set adjacent to the set including the x bus electrode.

These and other objects, features, aspects and advantages of the present invention will become more apparent from the following detailed description of the present invention when taken in conjunction with the accompanying drawings.

BRIEF DESCRIPTON OF THE DRAWINGS

DESCRIPTION OF THE PREFERRED EMBODIMENTS

First Preferred Embodiment

Figure 1:
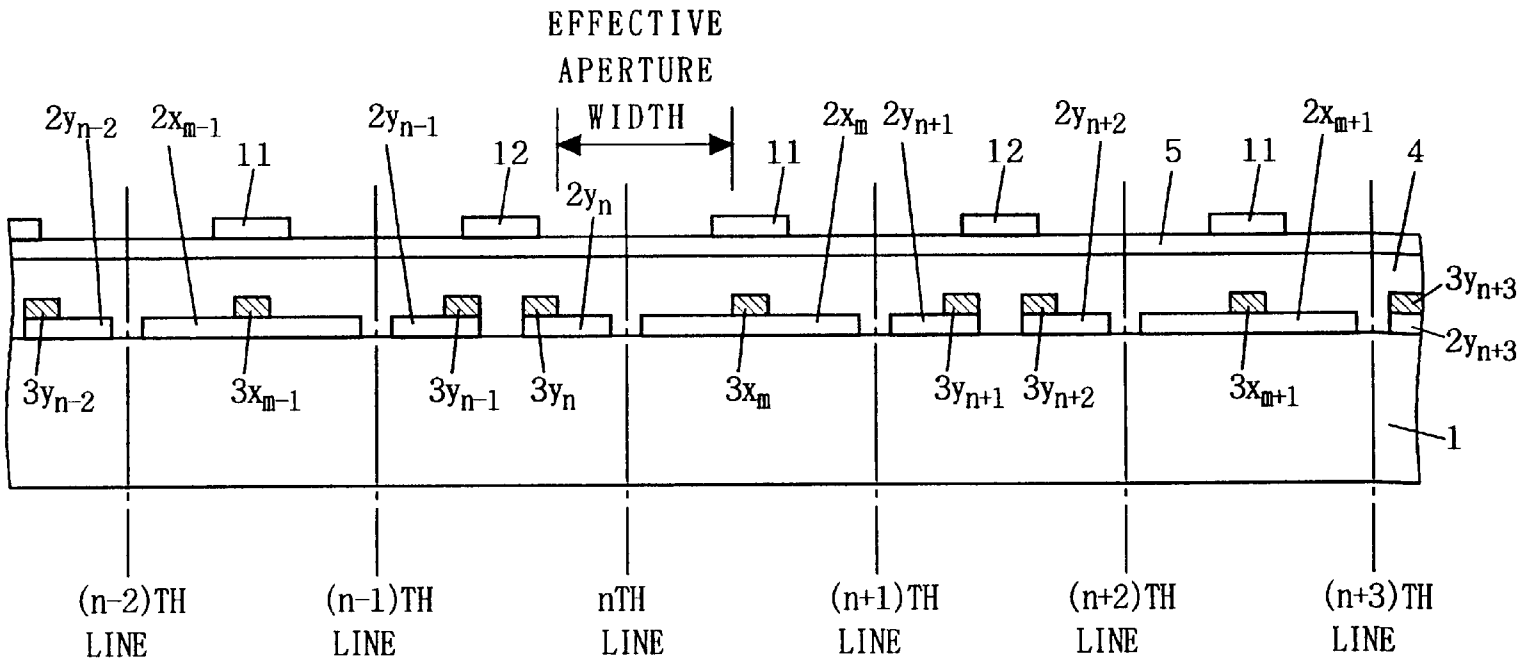
FIG. 1 is a sectional view showing a plasma display panel of a first preferred embodiment of the present invention.
Figure 5:
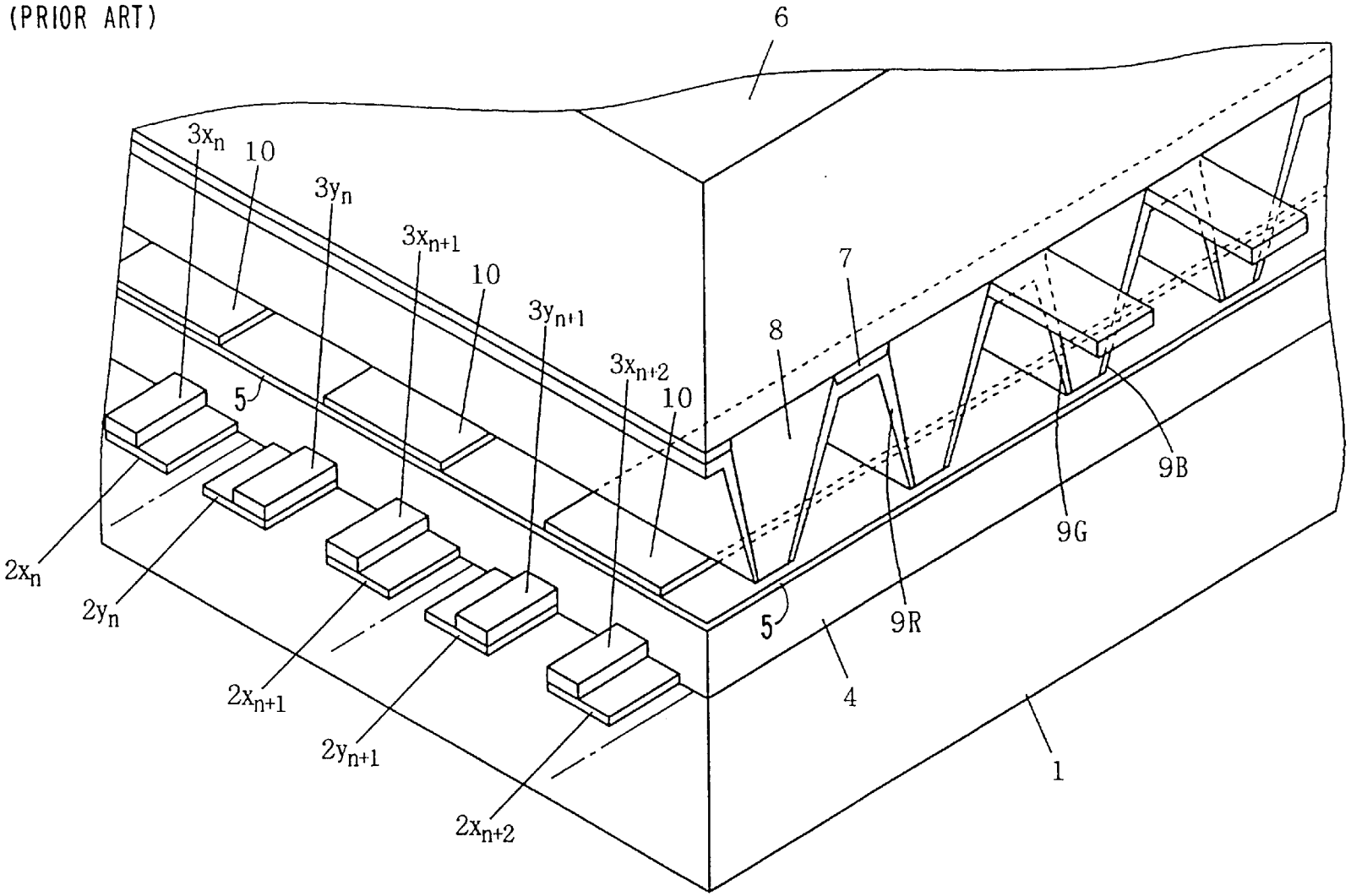
FIG. 5 (PRIOR ART)
FIG. 5 is a perspective view showing a plasma display panel of a background art.
Figure 6:
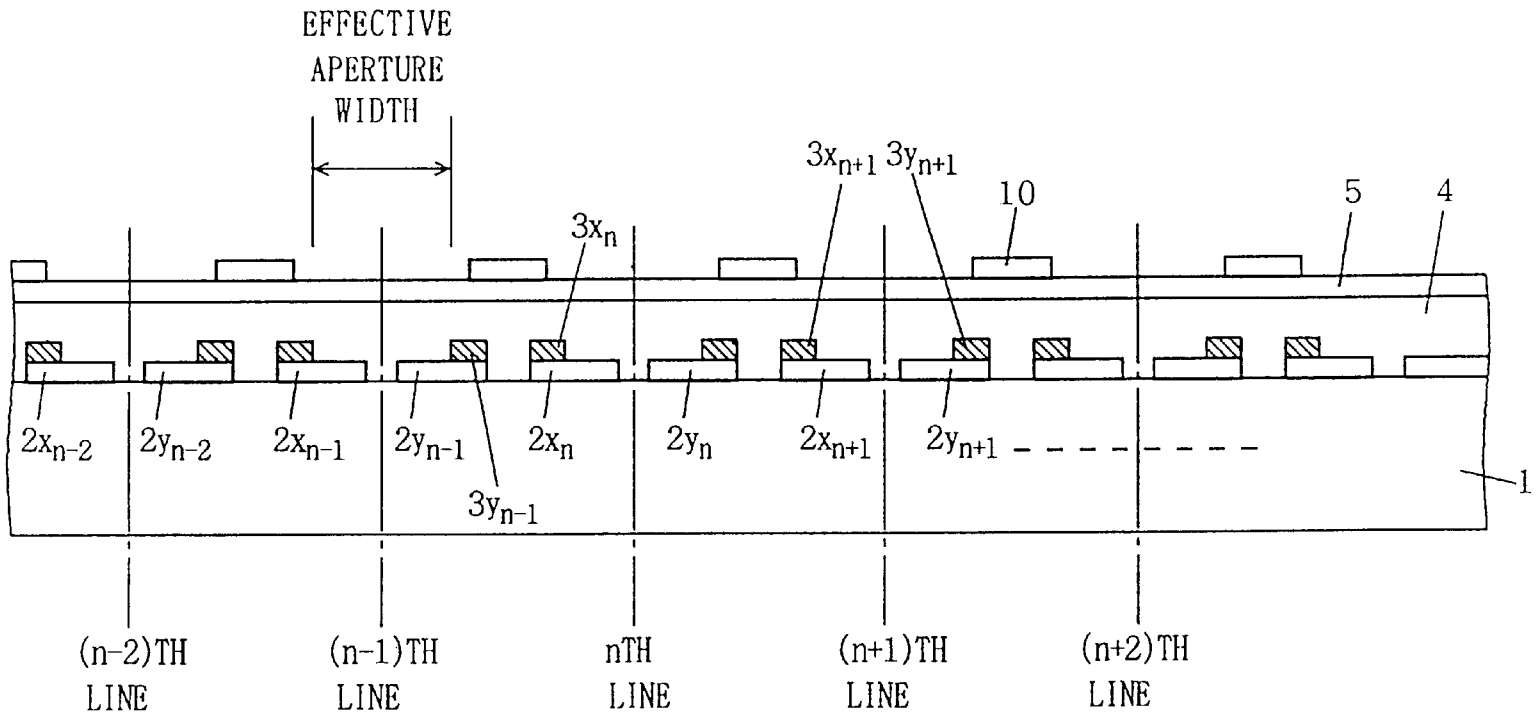
FIG. 6 (PRIOR ART)
FIG. 6 is a sectional view showing the plasma display panel of the background art.
Figure 7:
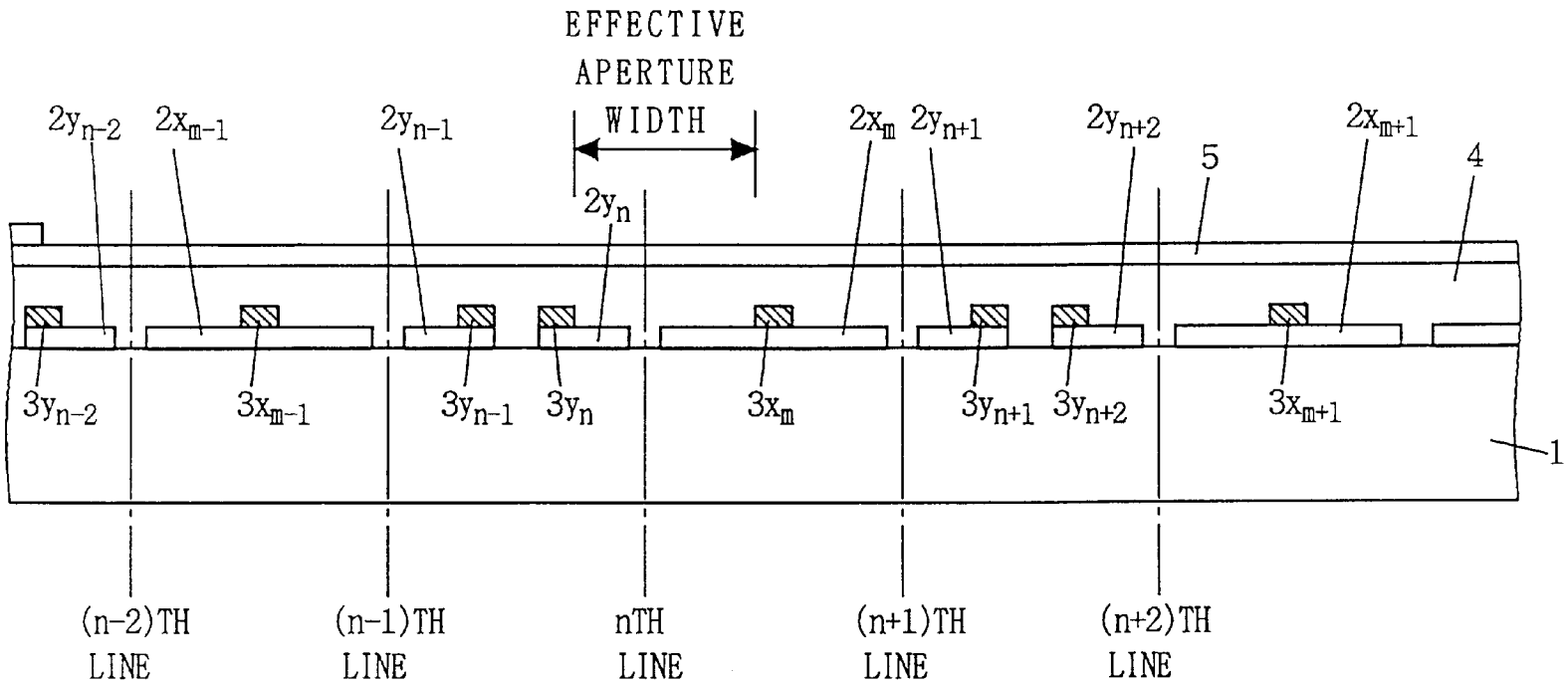
FIG. 7 (PRIOR ART)
FIG. 7 is a sectional view showing a plasma display panel of a background art.

A first preferred embodiment of a surface-discharge type plasma display panel according to the present invention will now be described referring to FIG. 1. FIG. 1 is a sectional view showing the plasma display panel. In FIG. 1, the same reference characters as those in the examples of background art show the same or corresponding parts and those parts are not described here again. The embodiment will be described in respect of the differences. Although not shown in FIG. 1, the rear glass substrate 6, the address electrodes 7, the partitions 8 and the phosphors 9R, 9G, 9B have the same structures as those in FIG. 5.

The x sustain discharge electrodes $\mathbf{2}x_{m-1}$ to $\mathbf{2}x_{m+1}$ and y sustain discharge electrodes $\mathbf{2}y_{n-2}$ to $\mathbf{2}y_{n+3}$ are arranged in the following order in the first preferred embodiment: y sustain discharge electrode $\mathbf{2}y_{n-2}$, x sustain discharge electrode $\mathbf{2}x_{m-1}$, y sustain discharge electrode $\mathbf{2}y_{n-1}$, y sustain discharge electrode $\mathbf{2}y_n$, x sustain discharge electrode $\mathbf{2}x_m$, y sustain discharge electrode $\mathbf{2}y_{n+1}$, y sustain discharge electrode $\mathbf{2}y_{n+2}$, x sustain discharge electrode $\mathbf{2}x_{m+1}$ and y sustain discharge electrode $\mathbf{2}y_{n+3}$. They extend perpendicular to the direction in which the address electrodes 7 shown in FIG. 5 extend. One x sustain discharge electrode, e.g., the x sustain discharge electrode $\mathbf{2}x_n$ makes discharge on the nth line with the y sustain discharge electrode $\mathbf{2}y_n$ and on the (n+1)th line with the y sustain discharge electrode $\mathbf{2}y_{n+1}$.

Since the x sustain discharge electrodes $\mathbf{2}x_{m-1}$ to $\mathbf{2}x_{m+1}$ are usually connected to a common electrode, no contradiction occurs in electrical interconnection when the x sustain discharge electrodes $\mathbf{2}x_{m-1}$ to $\mathbf{2}x_{m+1}$ are arranged in the above-mentioned order.

The character 11 denotes insulating parts serving as x discharge deactivation films, which are provided in positions facing the common electrodes or x bus electrodes $\mathbf{3}x_{m-1}$ to $\mathbf{3}x_{m+1}$ through the dielectric layer 4 and the cathode layer 5.

The character 12 denotes insulating parts serving as y discharge deactivation films, which are provided in positions facing the spaces between two adjacent independent electrodes or y bus electrodes, e.g., the space between the y bus electrode $\mathbf{3}y_n$ and the y bus electrode $\mathbf{3}y_{n-1}$, through the dielectric layer 4 and the cathode layer 5. One x bus electrode and two y bus electrodes on its both sides form one set of discharge sustain electrodes.

The width of the y discharge deactivation films 12 does not exceed the sum of the widths of two y bus electrodes in adjacent sets, e.g., the widths of the y bus electrode $\mathbf{3}y_n$ and the y bus electrode $\mathbf{3}y_{n-1}$, and the width of the space between the two y sustain discharge electrodes in the adjacent sets.

When the spacing between adjacent two y sustain discharge electrodes in adjacent sets, e.g., the spacing between the y sustain discharge electrode $\mathbf{2}y_{n-1}$ and the y sustain discharge electrode $\mathbf{2}y_n$ is sufficiently large, it is not particularly necessary to provide the y discharge deactivation films 12 shown in the first preferred embodiment.

In the first preferred embodiment, the cathode film 5 is laid on the dielectric layer 4 and the x and y discharge deactivation films 11 to 12 are patterned thereon. However, the x and y discharge deactivation films 11 to 12 may be laid plainly on the dielectric layer 4 and then the cathode film 5 may be patterned thereon in the negative shape of the x and y discharge deactivation film 11 to 12 shown in FIG. 1.

As discussed above, in the plasma display panel of the first preferred embodiment, one x bus electrode $3x_{m-1}$ (or $3x_m$; $3x_{m+1}$) is interposed and shared between two y bus electrodes $3y_{n-2}$, $3y_{n-1}$ (or $3y_n$, $3y_{n+1}$; $3y_{n+2}$, $3y_{n+3}$). Accordingly, when the same number of cells are formed on a plasma display panel having the same space as those in conventional ones, a reduced total number of x bus electrodes $3x_{m-1}$ to $3x_{m+1}$ and y bus electrodes $3y_{n-2}$ to $3y_{n+3}$ are formed on the front glass substrate 1. Then opposing x bus electrodes and y bus electrodes, e.g., the x bus electrode $3x_m$ and the y bus electrode $3y_n$, can be provided at larger gaps, thus improving the light emission luminance of the plasma display panel.

Furthermore, since the plasma display panel of the first preferred embodiment has the y discharge deactivation films 12 provided in the vicinities of the boundaries between adjacent sets of electrodes, e.g., in the position facing the interval between the adjacent y bus electrodes $3y_{n-1}$ and $3y_n$ through the dielectric layer 4 and the cathode film 5, the flow of discharge current is controlled. Accordingly, even if the intervals between adjacent two y sustain discharge electrodes in adjacent sets, e.g., the interval between the y sustain discharge electrode $2y_{n-1}$ and the y sustain discharge electrode $2y_n$, are small, the x sustain discharge electrode $2x_m$ and the y sustain discharge electrode $2y_{n-1}$ are prevented from being involved in discharge between the x sustain discharge electrode $2x_m$ and the y sustain discharge electrode $2y_n$ to erroneously discharge.

Furthermore, the plasma display panel of the first preferred embodiment has the x discharge deactivation films 11 in positions facing the x bus electrodes $3x_m$ –1 to $3x_{m+1}$ through the dielectric layer 4 and the cathode film 5. This prevents the problem that, for example, the wall charge to be held between the x sustain discharge electrode $2x_m$ and the y sustain discharge electrode $2y_{n+1}$ is lost by unwanted involvement in the discharge between the x sustain discharge electrode $2x_m$ and the y sustain discharge electrode $2y_n$. This allows the x sustain discharge electrode $2x_m$ and the y sustain discharge electrode $2y_{n+1}$ to stably discharge even after discharge has been started between the x sustain discharge electrode $2x_m$ and the y sustain discharge electrode $2y_n$.

Second Preferred Embodiment

Next, another preferred embodiment of the present invention will be described referring to FIG. 2. In the plasma display panel of the second preferred embodiment shown in FIG. 2, the spacing between two adjacent y sustain discharge electrodes in adjacent sets, e.g., the spacing between the y sustain discharge electrode $2y_{n+1}$ and the y sustain discharge electrode $2y_{n+2}$, is sufficiently larger than in the first preferred embodiment.

Figure 2:
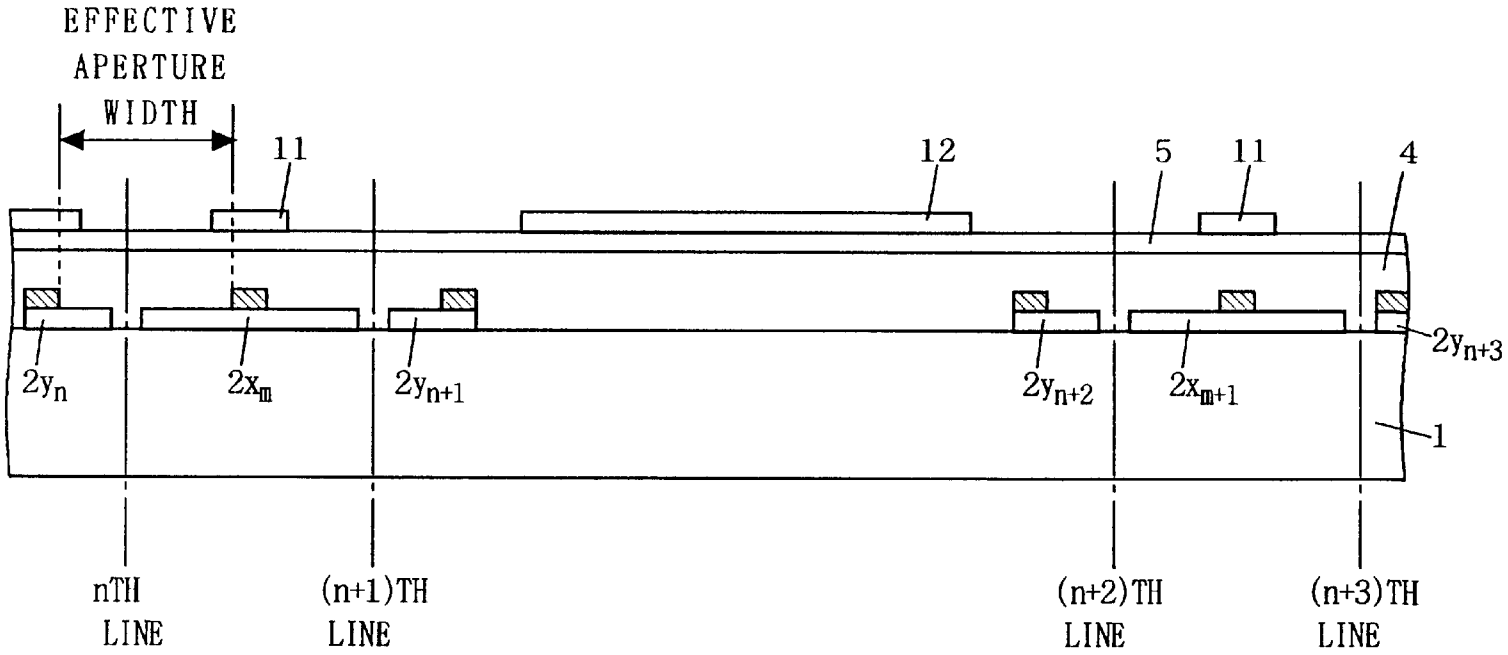
FIG. 2 is a sectional view showing a plasma display panel of a second preferred embodiment of the present invention.

In the plasma display panel of the second preferred embodiment shown in FIG. 2, a pattern of y discharge deactivation films 12 having a light-shielding property is formed in the positions facing the spaces between adjacent y sustain discharge electrodes, e.g., the space between the y sustain discharge electrode $2y_{n+1}$ and the y sustain discharge electrode $2y_{n+2}$, through the dielectric layer 4 and the cathode film 5.

The formation of the light-shielding y discharge deactivation films 12 prevents, to some extent, the problem that the white base of the phosphors 9R, 9G and 9B is seen through the spaces between adjacent two y sustain discharge electrodes in adjacent sets in the plasma display panel, thus improving the visual contrast of the plasma display panel.

The y discharge deactivation films 12 having a light-shielding property can be formed by bringing an insulating material for the y discharge deactivation films 12, e.g., aluminum oxide (hereinafter referred to as $Al_2O_3$) or titanium oxide (hereinafter referred to as $TiO_2$), to an oxygen-lacking state from the stoichiometric composition. This utilizes the phenomenon that these oxides present blacker tone with lack of oxygen.

Specifically, the y discharge deactivation films 12 containing oxygen-lacking oxide are formed by depositing a sample of $Al_2O_3$ or $TiO_2$ on the cathode film 5 while evaporating the sample with stoichiometric composition to decompose and eliminate part of oxygen. The y discharge deactivation films 12 formed of $Al_2O_3$ or $TiO_2$ have higher discharge voltage than the y discharge deactivation films 12 formed of MgO. Table 1 shows results of experiment showing this.

TABLE 1

| Discharge Deactivation Film | Physical Property Values: Linear Expansion Coefficient | Physical Property Values: Sputtering Yield (10 keV $kr^+$) | Physical Property Values: Work Function | Experimental Results (Discharge Voltage): Firing Voltage | Experimental Results (Discharge Voltage): Sustain Voltage |
|---|---|---|---|---|---|
| (MgO) | $130 \times 10^{-7}$/deg | 1.8 total atoms/ion | 3.1–4.4 | 224–250 V | 140–148 V |
| $Al_2O_3$ | $80 \times 10^{-7}$/deg | 1.5 total atoms/ion | 4.7 eV | 334–467 V | 275–428 V |
| $TiO_2$ | $90 \times 10^{-7}$/deg | 1.6 total atoms/ion | 6.21 eV | 373–422 V | 270–380 V |
| $SiO_2$ | $5 \times 10^{-7}$/deg | 3.6 total atoms/ion | 5.00 eV | — | — |

As discussed above, the plasma display panel of the second preferred embodiment has a pattern of y discharge deactivation films 12 having a light-shielding property laid in positions facing the spaces between adjacent y sustain discharge electrodes, e.g., the space between the y sustain discharge electrode $2y_{n+1}$ and the y sustain discharge electrode $2y_{n+2}$, with the dielectric layer 4 and the cathode film 5 interposed therebetween.

The formation of the y discharge deactivation films 12 having a light-shielding property prevents, to some extent, the problem that the white base of the phosphors 9R, 9G and 9B is seen through the spaces between adjacent two y sustain discharge electrodes in adjacent sets in the plasma display panel, thus improving the visual contrast of the plasma display panel.

Third Preferred Embodiment

Figure 3:
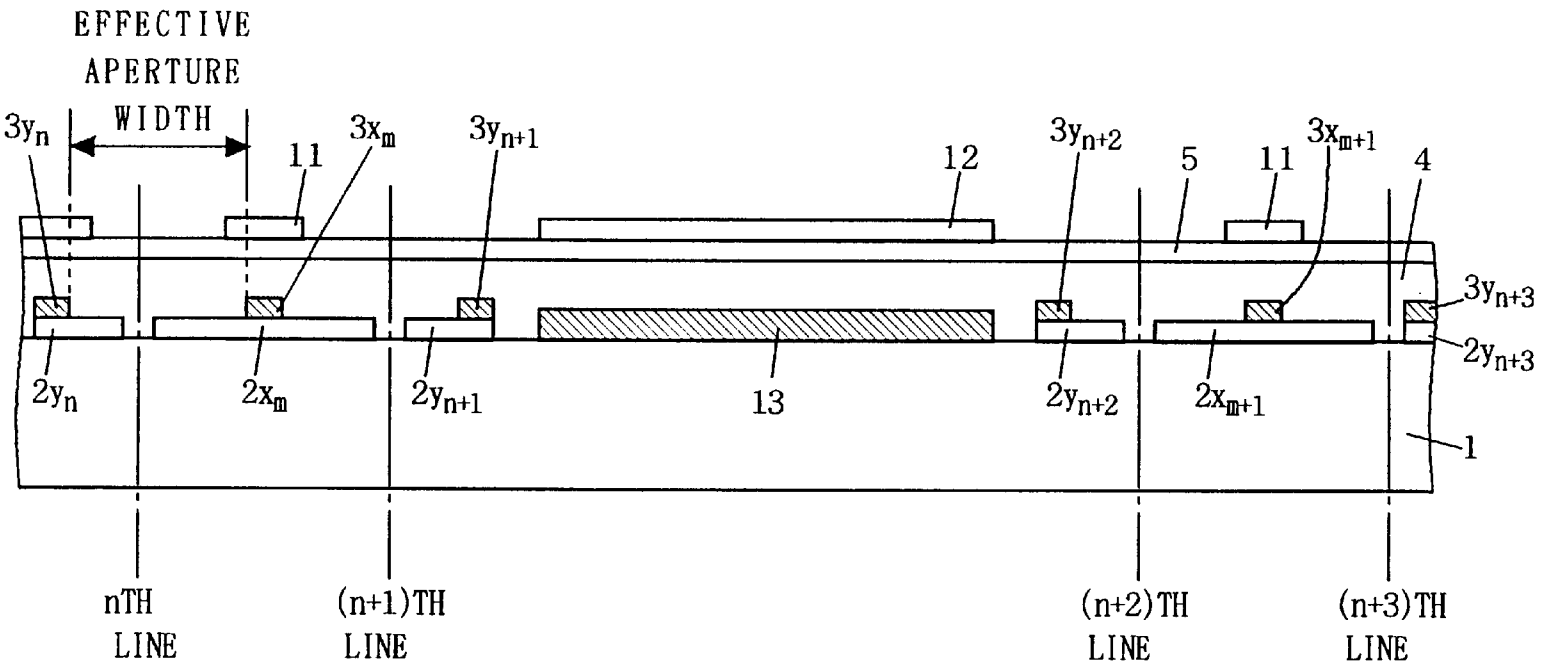
FIG. 3 is a sectional view showing a plasma display panel of a third preferred embodiment of the present invention.

Next, another preferred embodiment of the present invention will be described referring to FIG. 3. In the plasma display panel of the third preferred embodiment shown in FIG. 3, like in the second preferred embodiment, the spacing between two adjacent y sustain discharge electrodes in adjacent sets, e.g., the space between the y sustain discharge electrode $2y_{n+1}$ and the y sustain discharge electrode $2y_{n+2}$, is sufficiently large. In the plasma display panel shown in FIG. 3, metal shadow patterns 13 are provided as independent parts formed of the same material as the x bus electrodes $3x_m$ to $3x_{m+1}$ and the y bus electrodes $3y_n$ to $3y_{n+3}$ in the spaces between adjacent two y sustain discharge electrodes in adjacent sets shown in the second preferred embodiment, e.g., in the space between the y sustain discharge electrode $2y_{n+1}$ and the y sustain discharge electrode $2y_{n+2}$. The metal shadow patterns 13 are applied no external voltage, or floating.

Typically, the x bus electrodes $3x_m$ to $3x_{m+1}$ and the y bus electrodes $3y_n$ to $3y_{n+3}$ are formed of multi-layered film composed of chromium (Cr), copper (Cu) and Cr films, or multi-layered film composed of aluminum (Al) and Cr films. These multi-layered films have perfect light-shielding property. Especially, seen in many plasma display panels is the Cr film having dark metallic luster and a high light-shielding property. When a multi-layered film formed of Cr film is provided as the shadow pattern 13 in the space between the y sustain discharge electrode $2y_{n+1}$ and the y sustain discharge electrode $2y_{n+2}$, for example, it prevents the white base of the phosphors 9R, 9G and 9B from being seen through the space between the two adjacent y sustain discharge electrodes in adjacent sets in the plasma display panel, thus improving the visual contrast of the plasma display panel.

Since these multi-layered films are laid on the entire surface by sputtering deposition or the like and then shaped by photolithography and etching, the shadow patterns 13 can be easily formed by using the pattern design of photomask used in photolithography for the x bus electrodes and y bus electrodes. Accordingly, it is not necessary to add a new process for formation of the shadow patterns 13.

Figure 4:
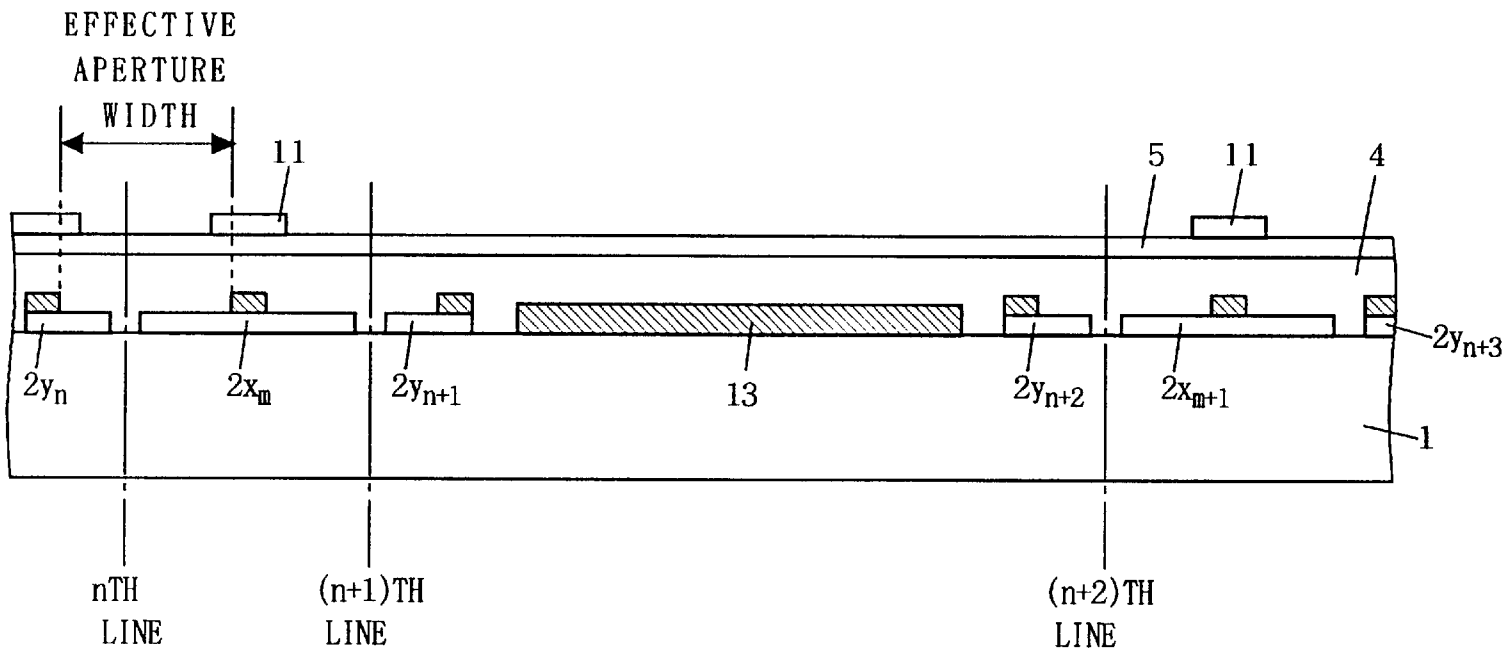
FIG. 4 is a sectional view showing a plasma display panel that does not have the y discharge deactivation films described in the third preferred embodiment of the present invention.

FIG. 4 is a sectional view showing a structure of a plasma display panel having the metal shadow patterns 13 without a pattern of y discharge deactivation films 12 in the positions facing the spaces between two adjacent y sustain discharge electrodes in adjacent sets, e.g., the space between the y sustain discharge electrode $2y_{n+1}$ and the y sustain discharge electrode $2y_{n+2}$ with the dielectric layer 4 and the cathode film 5 interposed therebetween. In this structure, discharge made between the x sustain discharge electrode $2x_m$ and the y sustain discharge electrode $2y_{n+1}$, for example, accumulates wall charge on the cathode film 5 facing the metal shadow pattern 13 through the dielectric layer 4, which causes spark discharge at certain instant.

Thus, the plasma display panel of the third preferred embodiment has the metal shadow patterns 13 having a light-shielding property and formed of the same material as the x bus electrodes $3x_m$ to $3_{m+1}$ and the y bus electrodes $3y_n$ to $3y_{n+2}$ in the intervals between two adjacent y sustain discharge electrodes in adjacent sets, e.g., in the space between the y sustain discharge electrode $2y_{n+1}$ and the y sustain discharge electrode $2y_{n+2}$. This prevents the white base of the phosphors 9R, 9G and 9B from being seen through the spaces between adjacent two y sustain discharge electrodes in adjacent sets on the plasma display panel, improving visual contrast of the plasma display panel. Furthermore, the plasma display panel of the third preferred embodiment reduces the risk of occurrence of spark discharge.

While the invention has been described in detail, the foregoing description is in all aspects illustrative and not restrictive. It is understood that numerous other modifications and variations can be devised without departing from the scope of the invention.

I claim:

1. A plasma display panel comprising:

a first glass substrate and a second glass substrate facing each other;

a plurality of sets of discharge sustain electrodes, each set including at least one common sustain electrode for adjacent display lines, provided on a surface of said first glass substrate that faces said second glass substrate, said common sustain electrodes extending in parallel with each other;

a dielectric layer coating said plurality of sets of discharge sustain electrodes;

a plurality of address electrodes provided in parallel in a direction perpendicular to said common sustain electrodes on a surface of said second glass substrate that faces said first glass substrate with a space interposed between said dielectric layer and said address electrodes;

partitions provided between said first and second glass substrates to divide said space into a plurality of cells;

a phosphor coating said partitions; and first insulating members comprising a film for restricting discharge operation facing said common sustain electrodes, each first insulating member associated with a corresponding one of the common sustain electrodes, said dielectric layer interposed between the first insulating members and the common sustain electrodes.

2. The plasma display panel according to claim 1, further comprising a cathode film provided between said first insulating members and said dielectric layer.

3. The plasma display panel according to claim 2, further comprising a cathode film provided between said first and second insulating members and said dielectric layer.

4. The plasma display panel according to claim 2, further comprising a cathode film so provided that said first and second insulating members are sandwiched between said dielectric layer and said cathode film.

5. The plasma display panel according to claim 2, wherein said first and second insulating members are formed by depositing the insulating material on said dielectric layer or said cathode film while evaporating the insulating material.

6. The plasma display panel according to claim 2, wherein said insulating material is mainly of $Al_2O_3$ or $TiO_2$.

7. The plasma display panel according to claim 6, wherein said independent parts have a chromium layer.

8. The plasma display panel according to claim 2, further comprising independent parts formed of a material having a light-shielding property and provided on said first glass substrate between adjacent ones of said independent electrodes in adjacent ones of said plurality of discharge sustain electrode sets.

9. The plasma display panel according to claim 1, further comprising a cathode film so provided that said first insulating members are sandwiched between said dielectric layer and said cathode film.

10. The plasma display panel according to claim 1, wherein said first insulating members are formed by depositing the insulating material on said dielectric layer or said cathode film while evaporating the insulating material.

11. The plasma display panel according to claim 1, wherein said insulating material is mainly of $Al_2O_3$ or $TiO_2$.

12. The plasma display panel according to claim 11, wherein said independent parts are formed of the same material as said independent electrodes.

13. The plasma display panel according to claim 1, wherein each set of discharge sustain electrodes further includes two independent sustain electrodes on both sides of said common sustain electrode, provided on a surface of said first glass substrate that faces said second glass substrate, said common sustain electrode and said two independent sustain electrodes extending generally parallel to each other;

and further comprising second insulating members comprising a film for restricting discharge operation, provided in positions facing spaces between adjacent ones of said independent sustain electrodes in adjacent ones of said plurality of discharge sustain electrode sets with said dielectric layer interposed between the second insulating members and the independent sustain electrodes.

14. A plasma display panel comprising:

a transparent substrate;

sets of discharge sustain electrodes associated with the transparent substrate, each set of discharge sustain electrodes including at least one common sustain electrode for adjacent display lines;

a dielectric layer overlying the sets of the discharge sustain electrodes;

a plurality of address electrodes oriented generally perpendicularly to the sets of the discharge sustain electrodes and spaced apart from the discharge sustain electrodes;

a plurality of gas discharge chambers defined between the sets of discharge sustain electrodes and the address electrodes; and a plurality of first insulating members spaced apart from one another and having sheetlike shapes, each of the first insulating members associated with a corresponding common sustain electrode, the dielectric layer interposed between the first insulating members and the sets of electrodes.

15. The plasma display panel according to claim 14 wherein each of the first insulating members has a first width that is equal to or less than a second width of the corresponding common sustain electrode.

16. The plasma display panel according to claim 14 wherein the first insulating member is laterally centered with respect to the corresponding common sustain electrode.

17. The plasma display panel according to claim 14, wherein each set of the discharge sustain electrodes further includes independent sustain electrodes laterally displaced with respect to the common sustain electrode, further comprising a plurality of second insulating members laterally separated from the first insulating members, the second insulating members associated with independent sustain electrodes from different sets.

18. The plasma display panel according to claim 17 wherein each second insulating member has a first width that is equal to or less than a second width, the second width equaling a sum of the independent sustain electrodes from the different sets and a lateral clearance dimension between the independent sustain electrodes from the different sets.

19. The plasma display panel according to claim 17 wherein the second insulating member is laterally centered with respect to the lateral clearance between the independent sustain electrodes from the different set.

* * * * *